US006679616B2

(12) United States Patent
Miller

(10) Patent No.: US 6,679,616 B2
(45) Date of Patent: Jan. 20, 2004

(54) MINIATURE FLASHLIGHT AND KEY CHAIN

(75) Inventor: Joseph T. Miller, St. Louis, MO (US)

(73) Assignee: MOCAP, Inc., St. Louis, MO (US)

( * ) Notice: Subject to any disclaimer, the term of this patent is extended or adjusted under 35 U.S.C. 154(b) by 0 days.

(21) Appl. No.: 09/849,410

(22) Filed: May 7, 2001

(65) Prior Publication Data

US 2001/0043470 A1 Nov. 22, 2001

Related U.S. Application Data

(60) Provisional application No. 60/205,582, filed on May 22, 2000.

(51) Int. Cl.[7] ..... F21L 4/06

(52) U.S. Cl. ..... 362/189; 362/203; 362/204; 362/116

(58) Field of Search ..... 362/189, 201, 362/203, 204, 206, 116

(56) References Cited

U.S. PATENT DOCUMENTS

| | | | | | |
|---|---|---|---|---|---|
| 1,591,627 | A | * | 7/1926 | Hopkins | 362/203 |
| 2,070,316 | A | | 2/1937 | Recker | 362/206 |
| 2,143,558 | A | | 1/1939 | Joers | 362/189 |
| 2,150,644 | A | * | 3/1939 | Batcheller | 362/203 |
| 2,258,074 | A | * | 10/1941 | Swanson | 362/203 |
| 2,367,888 | A | | 1/1945 | Prideaux | 362/206 |
| 2,666,894 | A | | 1/1954 | Babernitsh | 324/507 |
| 2,694,772 | A | | 11/1954 | Gelardin | 362/189 |
| 3,105,233 | A | | 9/1963 | D'Amore et al. | 340/815.69 |
| 3,244,871 | A | * | 4/1966 | Feldman | 362/203 |
| 3,665,178 | A | | 5/1972 | Sussingham et al. | 362/189 |
| 3,742,207 | A | | 6/1973 | Strauss | 362/206 |
| 4,109,405 | A | | 8/1978 | Ito | 43/17.5 |
| 4,281,368 | A | * | 7/1981 | Humber | 362/203 |
| 4,303,970 | A | | 12/1981 | Robertson | 362/203 |
| 4,774,643 | A | | 9/1988 | McGinnis et al. | 362/189 |
| 4,905,129 | A | | 2/1990 | Sharrah | 362/158 |
| 5,070,437 | A | | 12/1991 | Roberts, Sr. | 362/158 |
| 5,317,490 | A | * | 5/1994 | Miller | 362/206 |
| 5,601,359 | A | * | 2/1997 | Sharrah et al. | 362/204 |

* cited by examiner

*Primary Examiner*—Alan Cariaso
(74) *Attorney, Agent, or Firm*—Paul M Denk

(57) ABSTRACT

Flashlight activated by external pressure on one end of its casing to energize the lamp. The flashlight includes a casing for holding a battery and the contact portion a lamp, a front cap positioned on the front of the casing to secure the lamp protruding through an aperture, and a rear cap made of resilient material. A resilient spacer is positioned within the casing, intermediate the lamp and the battery to retain these two components out of contact in the nonilluminated state. External depression of the resilient rear cap urges the battery forward and the resilient spacer compressed to allow contact between the battery and base of the lamp. Contact wire electrically connects the lamp and battery to complete a circuit. Release of the rear cap allows the resilient spacer to expand, breaking contact between the battery and lamp, to turn off the flashlight.

6 Claims, 1 Drawing Sheet

MINIATURE FLASHLIGHT AND KEY CHAIN

CROSS-REFERENCE TO RELATED APPLICATION

This application claims priority to provisional application Ser. No. 60/205,582, filed May 22, 2000.

STATEMENT REGARDING FEDERALLY SPONSORED RESEARCH OR DEVELOPMENT

Not applicable.

BACKGROUND OF THE INVENTION

Numerous types of flashlights have been developed, assembled, and marketed over the years. In fact, many such flashlights have been made of a miniaturized size, so as to conveniently fit within an available but yet small capacity storage place, such as a glove compartment in an automobile, or even in the pocket, or pocketbook. One such flashlight is shown in my prior U.S. Pat. No. 5,317,490, relating to an encased flashlight, and which is assigned to a common assignee. In the structure of that device, the resiliency of the cap encasing the back of the flashlight, at the rear end of the battery, contains sufficient resiliency to provide for the contact providing for conduction of the charge, and lighting of its associated lamp.

This current invention provides and improved means for facilitating the shifting of the operative components of a flashlight together, to assure the electrical contact for ignition of the light.

SUMMARY OF THE INVENTION

This invention relates primarily to a miniaturized flashlight, and more specifically to a small scale flashlight that can be manipulated by the user into an operative and lighted condition, through the depressing of a resilient spacer.

This invention contemplates the formation of a small flashlight, generally one incorporating a single battery, although the essence of this invention may be incorporated into flashlights of larger scale and intensity. The novel flashlight includes a casing, end caps, with one end cap having an aperture therethrough for projection of a lamp, while the opposite end cap holds the battery in place within the casing. This last said end cap can be pressed or pushed to provide for lighting of the flashlight. A unique spacer, formed of a resilient material which may include plastic, vinyl, polymer, rubber, or the like, is positioned within the casing intermediate the lamp and the battery, normally holding these two components apart so as to maintain the flashlight in a inactive or non-lighted state. The external pushing of the end cap at the back of the battery causes the resilient spacer to collapse or compress to allow contact between the forward end of the battery and the base of the flashlight lamp causing the flashlight to light up. The resilient spacer incorporates such flexibility and resiliency so that when the flashlight is an inactivated stated, the spacer re-expands, separating the lamp from its battery, and thereby turning off the flashlight.

It is, therefore, among the objects of the present invention to provide a small flashlight which can be activated into operation through the external compression of an internal resilient spacer intermediate a battery and a lamp, thereby dispensing with the need for any type of a mechanical switch normally incorporated within a flashlight of this type.

Another object of this invention is to provide a flashlight of minor size, and which can be conveniently located in a small storage space, such as a pocket, pocketbook, case, or the glove compartment of an automobile.

Yet another object of the invention is to provide such a flashlight incorporating a key retainer ring on one end.

Another object of the current invention is to provide a flashlight fabricated from various components, and which can be facilely assembled during manufacture.

Still another object of this invention is to provide for a flashlight which is fabricated from various resilient and polymer or rubber-like components, and which are easy to assemble during usage, due to their stretchable and expandable qualities, and having the ability to contract, when assembled.

Yet another object of this invention is to provide a flashlight with relatively few parts, that is very easy to assemble during the manufacturing process.

These and other objects will become more apparent to those skilled in the art upon review of the summary as provided herein, and upon undertaking a study of the description of its preferred embodiment, in view of the drawings.

DESCRIPTION OF THE PREFERRED EMBODIMENTS

Figures 1, 2, 3, 4, 5, 6, 7, 8, 9, 10, 11, 12, 13, 14, 15, 16, 17, 18:
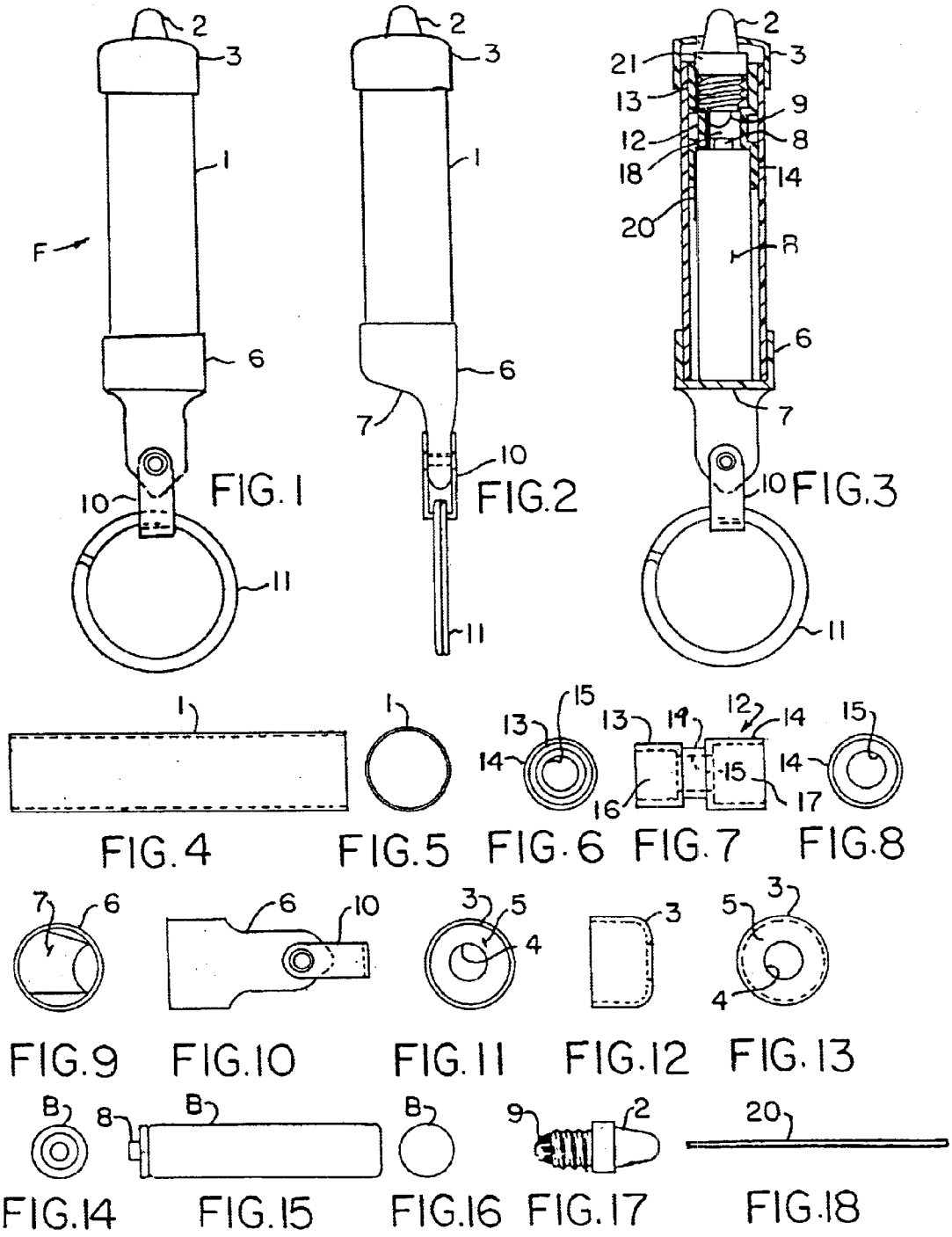
FIG. 1 is a top view of the miniature flashlight and key chain of this invention.
FIG. 2 is a side view thereof.
FIG. 3 is a top view, with the flashlight portion of the device being in longitudinal cross section to reveal its internal components.
FIG. 4 is a side view of the casing for the flashlight.
FIG. 5 is one end view of the casing of FIG. 4.
FIG. 6 is a back end view of the resilient spacer incorporated into the flashlight of this design.
FIG. 7 is a side view of the resilient spacer.
FIG. 8 is a front end view of the resilient spacer.
FIG. 9 is a back view of the rear mount for the flashlight.
FIG. 10 is a top view of the rear mount.
FIG. 11 is a front view of the rear mount.
FIG. 12 is a side view of the front cap for the flashlight.
FIG. 13 is a front view of the front cap.
FIG. 14 is a front view of a AAA or other battery used in this flashlight.
FIG. 15 is a side view of the battery.
FIG. 16 is a back view of the battery.
FIG. 17 is a side view of the flashlight lamp.
FIG. 18 is a view of the conductor wire that contacts the side of the lamp, and the battery, making contact between these two components in the electrical system of this assembled flashlight.

In referring to the drawings, and in particular FIGS. 1 through 3, the flashlight F of this invention is readily disclosed, It includes a body or casing 1 which may be made of any type of tubular material with an inner bore, having a length somewhat greater than the combined length of the base of the lamp 2 and the battery B, and which may be opaque, or transparent, in its construction, as desired. It is generally and preferably made of a polymer material, although it may be fabricated from other tubular or sleeve type stock. The forward end of casing 1 has a closure or cap 3, which can be integral or a cap as shown, which has an aperture, as at 4, formed through its wall 5, so as to allow for projection forwardly of the lamp 2, to provide for its ready observance and illumination, when the flashlight is energized. At the back end of the flashlight is the rear closure or cap 6, that-tightly embraces upon the lower end of the shown casing 1, in order to provide for retention of the battery B positioned within the casing 1, of the flashlight, when assembled. The rear closure or cap 6, just like the front cap 3, may be fabricated of any type of resilient polymer, such as vinyl, in order to allow for their tight fitting relationship upon the ends of the casing, when assembled, as can be understood.

In addition, the back wall 7 of the rear cap 6 has sufficient resiliency therein, so that when depressed or forced inwardly of the casing 1 by the application of external pressure, it shifts the battery upwardly or forwardly, to provide for contact between its front contact 8, and the base of the flashlight lamp 9, as can be understood. It can also be seen that a coupler 10 may be provided riveted to the back end of the rear cap 6, to provide a means for holding the key ring 11 in place, if desired. Obviously, the cap 6 could simply comprise a plain flexible cap, without any key ring, and still function just as effectively for the purposes of this invention.

The essence of this invention is the provision of the resilient sleeve 12 within the structure of the flashlight, arranged intermediate the lamp 2 and the battery B, as can be noted in FIG. 3. This resilient sleeve, as also shown in FIGS. 6 through 8, is formed of a resilient material, having sufficient flexibility to provide for its front portion 13 to grasp and retain the back end of the lamp 2, when assembled, while its back end 14 furnishes retention to the top of the battery, and secures it in position, when assembled. There is a opening or channel, as at 15, provided integrally and intermediate the cavity 16 formed within the rear segment 14 of the resilient sleeve, and the second cavity 17 formed of the same sleeve. This channel 15 integrally formed therein between these two cavities, provides a clearance area into which the lower end 9 of the lamp may locate, in addition to the upper or contact 8 of the battery, may likewise locate. But, in the static or "off" state, as can be seen in FIG. 3, there is reasonable clearance, as at 18, provided within this cavity 15, so as to separate these two components when the flashlight is inactivated or not in use. The resilient sleeve 12 has sufficient resiliency so that its intermediate and integral sleeve portion 19 formed therein will have a tendency to collapse, when external pressure is applied to the back wall 7 of the rear cap 6, thereby forcing or urging the battery B forwardly and allowing its contact 8 to make contact with the base 9 of the lamp 2, to energize the lamp and provide for illumination of the flashlight. As can also be seen, arranged between the lamp, and the battery, is a contact wire 20, which maintains constant electrical contact with the side of the lamp 2, as can be seen at 21, and with the side of the battery B, as noted. Thus, this wire 20, in addition to the contact made between the contact 8 and the base 9 of the lamp when the back wall 7 of the rear cap 6 is pushed, completes a circuit and allows for energizing or ignition of the lamp 2 which will remain on and lighted, so long as pressure is applied and the parts are in contact. But, when the back wall 7 is release, there is sufficient resiliency within the intermediate portion 19 of the resilient spacer 12, so as to provide for its inherent resiliency to expand this component, thereby separating the lamp base 9 and the contact 8 and to break the electrical circuit, thereby allowing the lamp to de-energize and turn off.

The resiliency of the spacer 12 is such so as to allow for its expansion, and gripping of the base of the lamp 2, when it is located within its cavity 17, and likewise has similar inherent resiliency within its segment 14, so as to grasp the upper end of the battery B, when located therein. Then, the intermediate portion 19 also has inherent resiliency, so as to allow for its collapse to achieve contact between the lamp and battery when depressed, but when in the steady state, inherently expand, through its own resiliency, to separate these components and turn off the flashlight. The diameter of this intermediate spacer 12 is such as to allow for its inherent resiliency to achieve these results, when operated within the assembled flashlight.

It is also just as likely that the resilient sleeve 12 could be fabricated of similar type of resilient or sufficiently flexible material, such as polymer, but be doped with sufficient conductive material, in its fabrication, whether it be metallic, carbon, or any other type of material that can be added to the polymer formed sleeve 12, so that charge could be conductive directly through the sleeve, and thereby, avoid the necessity of using a contact wire 20 to complete the circuit as can be understood. Or, the resilient spacer or sleeve may be a spring.

Variations or modifications to the subject matter of this invention may occur to those skilled in the art upon reviewing the disclosure as provided herein. Such variations or modifications are intended to be encompassed within the scope of any invention for this development, as described. The description of the preferred embodiment, and the drawings as provided herein, are set forth for illustrative purposes only.

What is claimed is:

1. A flashlight comprising:

a casing having an inner bore;

a wall at a first end of the casing having an opening formed therein;

a lamp within the bore of the casing at the first end thereof and extending out of the opening in the wall at the first end;

a flexible, resilient closure at a second end of the casing;

a battery in the casing bore adjacent the flexible, resilient closure; and a compressible, resilient spacer between the lamp and the battery, said spacer having a channel therethrough, and said spacer having openings at each end thereof and communicating with said channel, the opening at one end of said spacer provided for securing to the approximate end of the battery, the opening at the opposite end of the spacer provided for resiliently grasping the back end of the lamp, said first and second openings of the spacer communicating through said channel therebetween, whereby upon external pressure applied upon the closure at the end of the casing urges the battery against the spacer so as to compress and collapse said spacer creating an electrical contact between the battery and the lamp to energize the lamp for illumination; and an electrical contact wire contiguous internally of the spacer and located between the lamp and the battery so as to provide electrical contact therebetween.

2. The flashlight of claim 1 wherein the compressed and collapsed spacer and the electrical contact wire contiguous internally of the spacer and located between the lamp and the battery so as to provide electrical contact therebetween.

3. The flashlight of claim 1 wherein the casing is made of polymer, and said polymer is vinyl.

4. The flashlight of claim 1 wherein the spacer includes sufficient conductive materials so that charge can be conducted directly through the spacer.

5. The flashlight of claim 1 and further comprising a key ring at the second end of the casing.

6. The flashlight of claim 1 wherein the casing is formed from a polymer.

* * * * *